US005362247A

United States Patent [19]

Rodriguez

[11] Patent Number: 5,362,247

[45] Date of Patent: Nov. 8, 1994

[54] ROTARY BOARD RETAINER SYSTEM FOR ACTIVE ELECTRICAL CONNECTOR ASSEMBLY

[75] Inventor: Charles J. Rodriguez, Clearwater, Fla.

[73] Assignee: The Whitaker Corporation, Wilmington, Del.

[21] Appl. No.: 141,154

[22] Filed: Oct. 21, 1993

[51] Int. Cl.[5] ..... H01R 13/62

[52] U.S. Cl. ..... 439/330; 439/66; 439/326; 439/931

[58] Field of Search ..... 439/330, 331, 326, 341, 439/325, 61, 62, 66, 76, 74, 80, 79, 931

[56] References Cited

U.S. PATENT DOCUMENTS

| | | | |
|---|---|---|---|
| 3,638,163 | 1/1972 | Loosme . | |
| 3,985,413 | 10/1976 | Evans . | |
| 4,542,949 | 9/1985 | Tewes et al. | 439/330 |
| 4,818,241 | 4/1989 | Smoot | 439/65 |
| 5,035,628 | 7/1991 | Casciotti et al. | 439/66 |
| 5,046,955 | 9/1991 | Olsson | 439/322 |
| 5,118,300 | 6/1992 | Zarreii | 439/79 |
| 5,228,866 | 7/1993 | Espenshade et al. | 439/331 |
| 5,249,972 | 10/1993 | Walker | 439/330 |

OTHER PUBLICATIONS

U.S. Ser. No. 07/996,759, filed Dec. 24, 1992— "Wire Retainer for Current Mode Coupler"; William J. Rudy, Jr., et al. (Abstract and Drawings only included).

*Primary Examiner*—Larry I. Schwartz
*Assistant Examiner*—Hien D. Vu
*Attorney, Agent, or Firm*—Anton P. Ness

[57] ABSTRACT

A rotary retainer system for holding a board (14) with active electrical components in an electrical connector assembly includes a boss (50) secured to the housing (48) of the connector assembly, with the boss having an elongated slot (52) open toward the other end of the housing. The slot is sized so that one end of the board is receivable therein with sufficient clearance to allow pivoting motion of the board about that one end within the slot. At the other end of the connector assembly housing are several rotary retainers (68) each having a post (70) disposed in a cavity (54) of the housing. The post and the cavity are so configured that the post can only be inserted and removed from the cavity when in a predetermined angular orientation, with all other allowable angular orientations of the post preventing removal of the post from the cavity. The retainer also has a head (72) which, when the post is in the predetermined angular orientation, allows the board to pass thereby. Thereafter, rotation of the retainer results in the head coming into overlying engagement with the board.

9 Claims, 4 Drawing Sheets

ROTARY BOARD RETAINER SYSTEM FOR ACTIVE ELECTRICAL CONNECTOR ASSEMBLY

FIELD OF THE INVENTION

This invention relates to an electrical connector assembly utilizing an intermediate board with active electrical components and, more particularly, to a resilient retainer system for such a board.

BACKGROUND OF THE INVENTION

U.S. Pat. No. 5,118,300, issued Jun. 2, 1992, discloses in FIGS. 14–16 a connector assembly for interconnecting a daughter board and a mother board. This connector assembly includes an elastomeric contact element of the type disclosed in U.S. Pat. No. 3,985,413, issued Oct. 12, 1976, and sold under the trademark AMPLIFLEX by AMP Incorporated of Harrisburg, Pa., for incorporating a circuit with active elements in the paths between the daughter board and the mother board. The contents of U.S. Pat. No. 5,118,300 and the contents of U.S. Pat. No. 3,985,413 are hereby incorporated by reference herein.

As disclosed in the '300 patent, the active element circuit is mounted on a board secured to the connector assembly by an overlying spring clip which is removably clampable around opposed sides of the connector assembly housing. While effective for its intended purpose, the spring clip is relatively difficult to manipulate when a circuit board is installed to, and/or removed from, the connector assembly. In addition, the spring clip is a relatively expensive item.

It is therefore an object of the present invention to provide a board retainer system for an active electrical connector which is easier to utilize and is less costly than the spring clip of the '300 patent.

SUMMARY OF THE INVENTION

The referenced '300 patent discloses a connector assembly which electrically interconnects a first plurality of conductors on the surface of a dielectric substrate with respective ones of a second plurality of conductors on the surface of a dielectric housing. The connector assembly includes a resilient contact element having an elongated cylindrical elastomeric body member and a flexible film wrapped around the body member, the film having a third plurality of parallel straight line conductors on its surface facing away from the body member so that the third plurality of conductors extends around the body member. There are at least as many of the third plurality of conductors as there are of each of the first and second pluralities of conductors. The dielectric housing has an elongated open channel on its surface supporting the contact element therein, with the second plurality of conductors on the housing surface being within the channel. The connector assembly also includes means for retaining the contact element within the open channel. In accordance with the principles of this invention, the foregoing and additional objects are attained by providing an arrangement for securing the substrate to the housing. This arrangement comprises substrate receiving means secured to the housing for receiving one end of the substrate preferably at three spaced locations therealong, the receiving means being arranged to allow pivoting movement of the substrate about an axis substantially parallel to the direction of elongation of the open channel. The inventive arrangement further comprises preferably three retainers each mounted to the housing on the side of the channel away from the receiving means for holding the opposed end of the substrate. The housing is formed with preferably three cavities at spaced locations therealong, each of which is open to the housing surface on the side of the channel away from the receiving means and each retainer includes a post portion extending into the cavity to allow rotation of the retainer about an axis substantially orthogonal to the direction of elongation of the channel. Each retainer further includes a head portion secured to the post portion and rotatable therewith to allow the substrate to be received by the receiving means and pivoted past the head portion, with the head portion being thereafter rotatable with the post position so as to overlie the opposed end of the substrate. Each retainer preferably includes a radial projection at the end of the post portion which during rotation enters into an enlarged region of the cavity and bears against an upper surface of the region which assures that a substrate-engaging surface of the head portion cams against the upper surface of the substrate edge portion to urge the substrate to press against the pair of resilient contact elements. Each of the receiving means and each retainer are so configured that when the substrate is received by the receiving means and thereafter held by the retainers, the contact element is deformably compressed by the substrate within the channel, thereby insuring good electrical connections.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION OF THE PREFERRED EMBODIMENT

Figure 1:
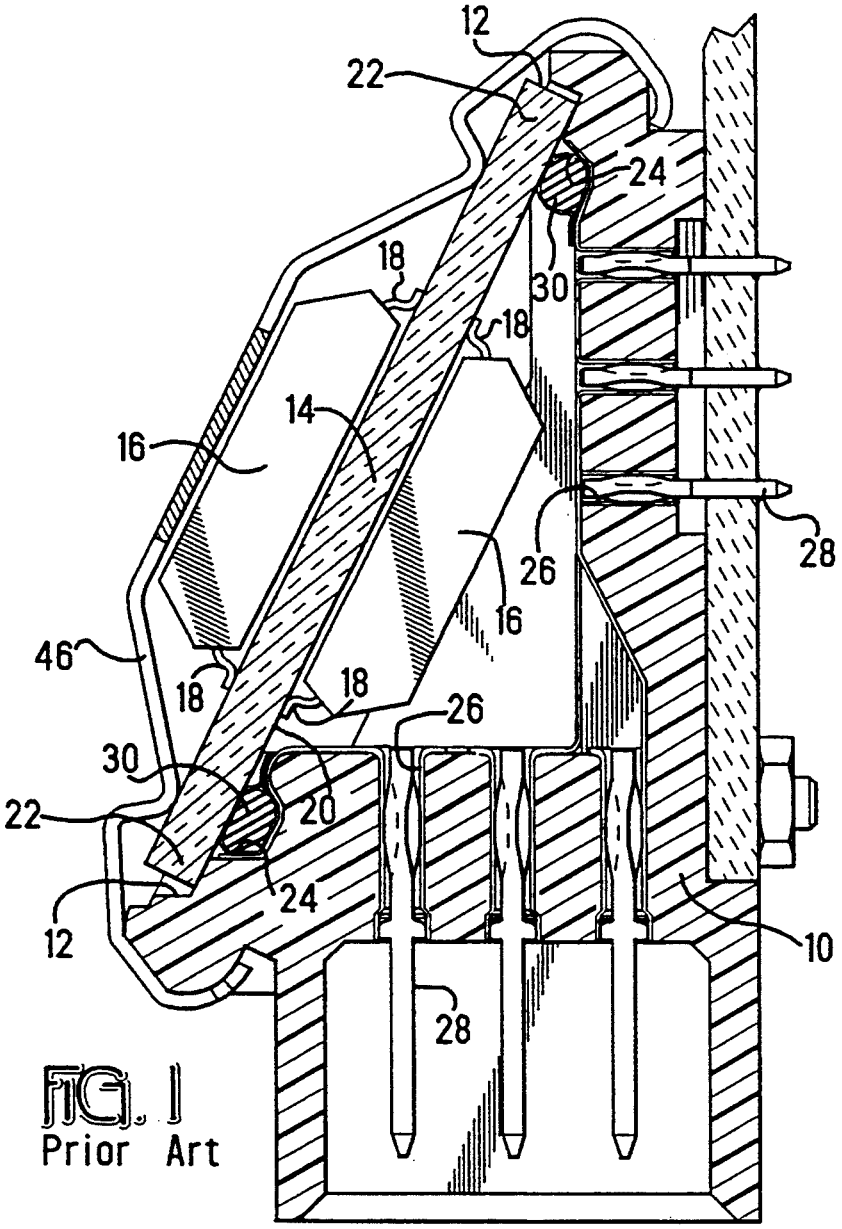
FIG. 1 Prior Art
FIG. 1 is an elevational and sectional view of the prior art connector assembly of the referenced U.S. Pat. No. 5,118,300.

As shown in FIG. 1, the connector assembly disclosed in the referenced U.S. Pat. No. 5,118,300 includes a housing 10 of dielectric material suitable for the coating or plating of conductive material thereon. The housing 10 includes, on interior surfaces thereof, a pair of spaced apart surfaces 12 adapted to receive a dielectric substrate 14 including one or more active components 16. The components 16 have leads 18 soldered surface-mount style to conductors on the surface 20 of the substrate 14 and which extend to the opposed ends 22 of the substrate 14.

Adjacent to the surfaces 12 are elongated open channels 24 which have end portion of surface conductors therein which in turn join conductive material extending into the cavities 26 within the housing 10, to be engaged by the contacts 28. Held within the channels 24 are resilient contact elements 30 of the type shown in FIG. 2 and disclosed in the referenced U.S. Pat. No. 3,985,413.

Figure 2:
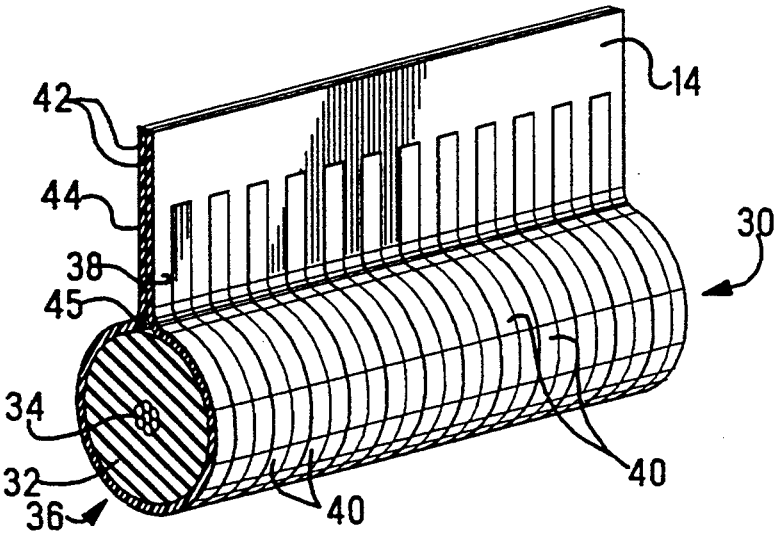
FIG. 2 Prior Art
FIG. 2 is a perspective view of the elastomeric contact element disclosed in the referenced U.S. Pat. No. 3,985,413.

As shown in FIG. 2, each of the contact elements 30 comprises a cylindrical elastomeric body 32 which may have a center core 34 of fiber glass or metal strands. A flexible circuit generally indicated at 36 is wrapped around the body 32. The flexible circuit 36 comprises a thin film 38 of polymeric material which should be flexible so that it can be wrapped around the body 32 but which will not elongate significantly when stressed in a tensile mode. The film 38 has a plurality of parallel relatively narrow straight conductors 40 on its external surface which faces away from the body 32. The width of the film 38 as viewed in FIG. 2 is significantly greater than the circumference of the body 32. The marginal side portions 42 are against each other and extend radially with respect to the body 32 to form a tab 44. The opposed surfaces of these marginal side portions 42 are bonded to each other by suitable bonding material 45. The conductors 40 are of uniform length and have their ends in alignment. These ends do not extend to the side edges of the film (i.e., the free end of the tab 44) so that there is a portion of film adjacent to the free end of the tab 44 which is devoid of conductors. Preferably, the conductors 40 are about 0.003 inches wide and spaced apart about 0.007 inches. Thus, for each of the conductors on the surface 20 of the substrate 14 and for each of the conductors within the channels 24 of the housing 10, there is a multiplicity of individual conductors 40 of the contact element 30. This multiplicity is on the order of two or three.

Each of the contact elements 30 is held within a respective one of the channels 24 and is resilient to provide a force driving the conductors 40 outwardly in a manner to interconnect the conductors on the substrate 14 with respective ones of the conductors on the surfaces of the channels 24.

The substrate 14 is secured to the housing 10 by a spring clip or bracket 46. With the bracket 46 latched in place, as shown in FIG. 1, the substrate 14 is urged firmly against the connectors 30 to thereby deformably compress the connectors 30 against the surfaces of the channels 24 and establish assured electrical connection between the conductors on the substrate 14 and respective ones of the conductors in the channels 24.

Figure 3:
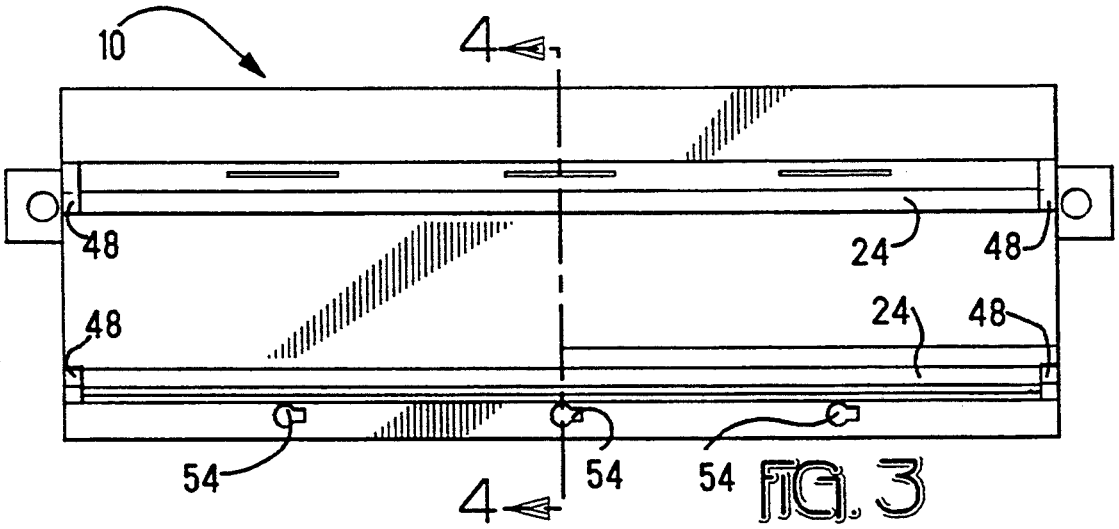
FIG. 3 is a top plan view of a housing for a connector assembly of the type shown in FIG. 1 adapted for the board retainer system according to this invention.
Figure 4:
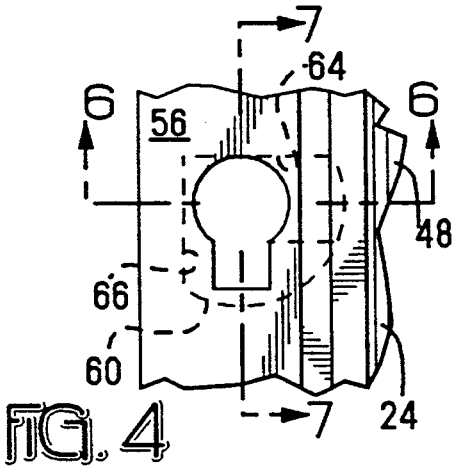
FIG. 4 is an enlarged top plan view of a portion of the housing showing the cavity for the retainer.
Figure 5:
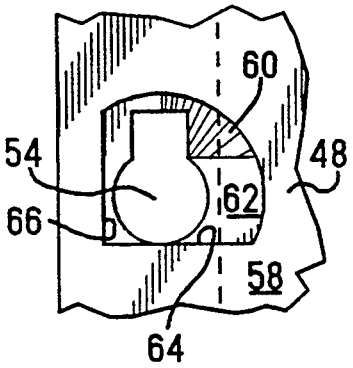
FIG. 5 is an enlarged bottom plan view of the housing of FIG. 3 showing the cavity for the retainer.

FIG. 3 is a plan view of the housing 48 which has been modified from the housing 10 shown in FIG. 1 in order to accommodate the board retainer system according to this invention. To avoid unduly complicating the drawings, the conductors on the surface of the housing 48 are not shown in FIG. 3. The housing 48 is modified from the housing 10 shown in FIG. 1 in two respects. First, the housing 48 includes means for receiving one end of the substrate 14, illustratively a boss 50 secured thereto. (See FIG. 15 as well.) Preferably, the boss 50 is formed as an integral part of the housing 48 and has an elongated slot 52 which is open toward the channels 24. The size of the slot 52 is such that an end of the substrate 14 is receivable therein with sufficient clearance so that the substrate 14 can be pivoted about that end within the slot 52. Although a boss 50 and a slot 52 have been shown, it is contemplated that other structure may be utilized for receiving an end of the substrate 14 which allows pivoting movement of the substrate 14 about an axis substantially parallel to the direction of elongation of the channels 24. For example, retaining clips secured within cavities in the housing 48 can be utilized.

Figure 6:
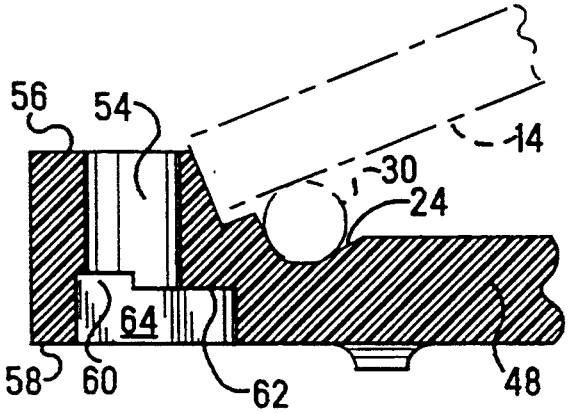
FIG. 6 is a cross sectional view taken along the line 6—6 in FIG. 4.
Figure 7:
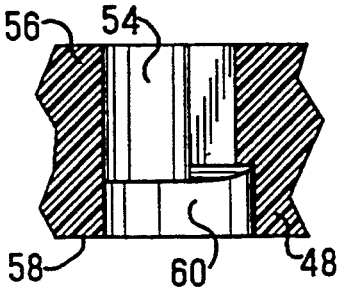
FIG. 7 is a cross sectional view taken along the line 7—7 in FIG. 4.
Figure 8:
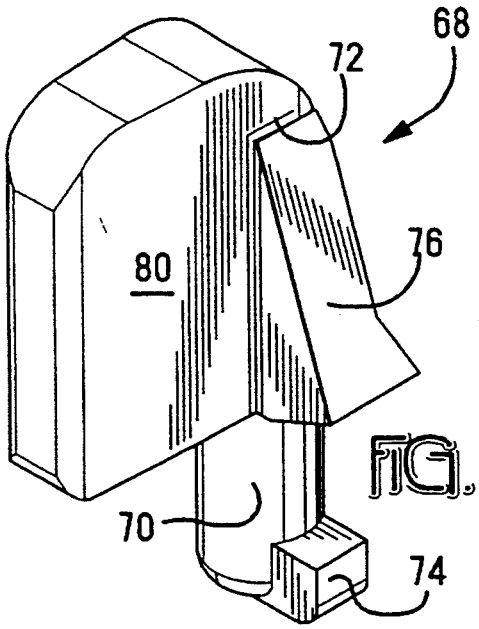
FIG. 8 is a perspective view of a retainer constructed in accordance with the principles of this invention adapted for use with the housing of FIG. 3.
Figure 9:
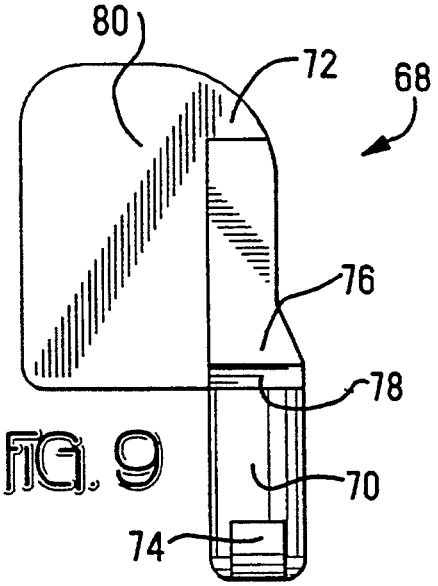
FIG. 9 is a front elevational view of the retainer of FIG. 8.
Figure 10:
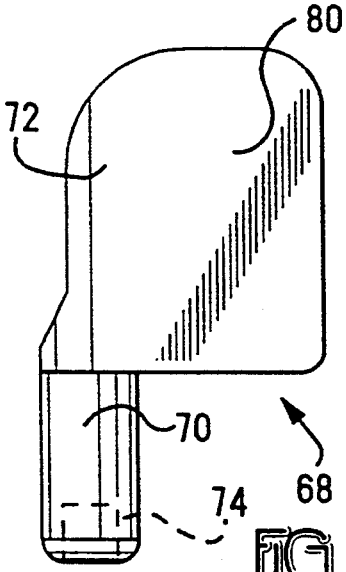
FIG. 10 is a rear elevational view of the retainer of FIG. 8.
Figure 11:
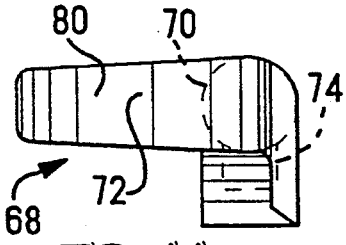
FIG. 11 is a top plan view of the retainer of FIG. 8.
Figure 12:
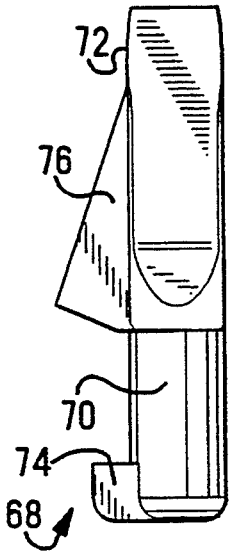
FIG. 12 is a side elevational view of the retainer of FIG. 11.

According to this invention, the second modification is that across the channels 24 from the boss 50, the housing 48 is formed with at least one cavity 54. Each of the cavities 54, illustratively three in number, is adapted to contain a rotary retainer for the other end of the substrate 14. As is best shown in FIGS. 4–7, each of the cavities 54 is generally keyhole-shaped as viewed at the upper surface 56 of the housing 48. Preferably, for ease in molding of the housing 48, the cavity 54 extends through to the lower surface 58 of the housing 48. As best shown in FIGS. 6 and 7, at the end of the cavity 54 which is remote from the surface 56 (i.e., adjacent the surface 58), the cavity 54 is formed with an enlarged region 60 including an upper wall 62 and a pair of angularly displaced generally vertical walls 64 and 66, the purpose of which walls: will become clear from the following discussion. Preferably, the walls 64 and 66 are at substantially a right angle with respect to each other.

The cavity 54 is configured to receive therein a retainer 68 and to allow rotation of the retainer 68 about an axis substantially orthogonal to the direction of elongation of the channels 24. The retainer 68 is best shown in FIGS. 8–12. Thus, each retainer 68 includes a post 70 and a head 72. The post 70 is generally cylindrical and has a radially extending projection 74 at its end remote from the head 72. Accordingly, the post 70 can only be inserted into the cavity 54 in a predetermined angular orientation. The spacing of the projection 74 from the head 72 is sufficient so that the projection 74 extends into the enlarged region 60 of the cavity 54 after the post 70 has been inserted to a predetermined depth. This allows rotation of the retainer 68 about an axis substantially orthogonal to the direction of elongation of the channels 24. The maximum extent of this rotation is limited to approximately ninety degrees by interference between the projection 74 and the walls 64 and 66. Further, upon such rotation from the predetermined angular orientation of insertion of the retainer 68, interference between the projection 74 and the upper wall 62 of the enlarged region 60 prevents removal of the retainer 68 unless it is in that predetermined angular orientation.

The head 72 of the retainer 68 includes a radially extending projection 76 having an engagement surface 78 which is generally planar and inclined at an angle extending away from the post. 70 in both the radial and longitudinal directions. This is because, as can best be viewed in FIG. 15, the substrate 14 is held at an angle relative to the axis of rotation of the retainer 68, and the engagement surface 78 is inclined at that same angle. The head 72 of the retainer 68 further includes a handle portion 80 which allows operator manipulation of the retainer 68. Illustratively, the handle portion 80 is a generally flat projection away from the axis of rotation of the retainer 68.

Figure 13:
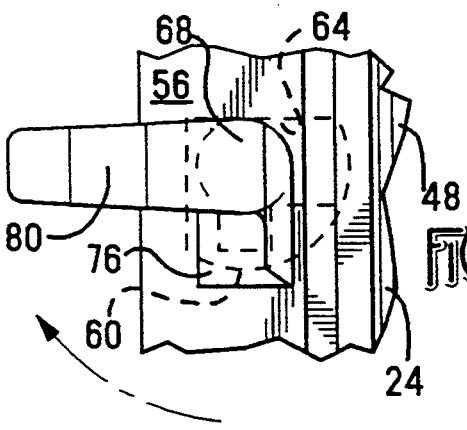
FIG. 13 is a top plan view similar to FIG. 4 showing the retainer installed in the cavity and in a position in which the substrate can be removed or installed.
Figure 14:
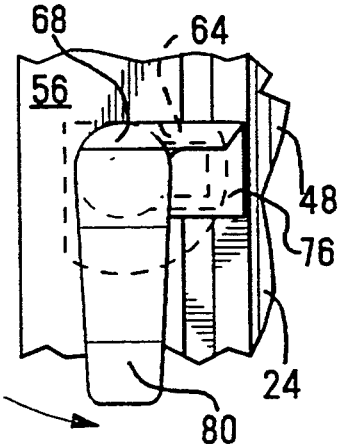
FIG. 14 is a top plan view similar to FIG. 13 showing the retainer in a position where the substrate is secured.
Figure 15:
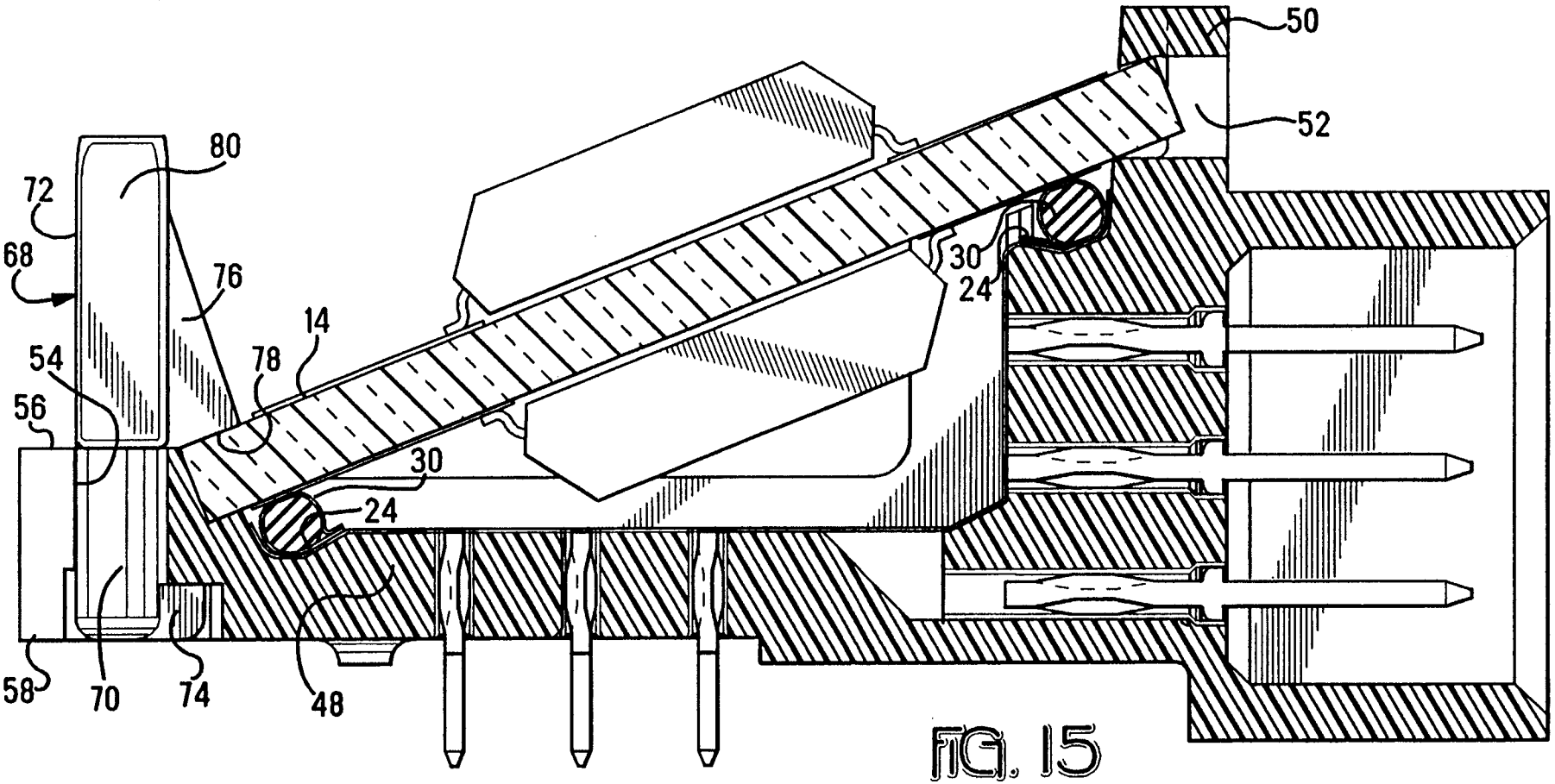
FIG. 15 is a cross sectional view of the connector assembly according to this invention, illustrating the inventive board retainer system in its operative condition.

FIGS. 13 and 14 illustrate the extremes of rotation of the retainer 68. As shown in FIG. 13, at the first extreme, the retainer 68 is rotated in the clockwise direction shown by the arrow, so that the head projection 76 is moved away from the channel 24. This allows one end of the substrate 14 to be received within the slot 52 (FIG. 15) with the substrate 14 being thereafter pivoted toward the surface of the housing 48 with its other end being unobstructed by the projection 76. It is noted that this angular orientation of the retainer 68 is the position for insertion and removal of the retainer 68 from the cavity 54. FIG. 14 shows the other extreme of rotation of the retainer 68 when it is moved counter clockwise, as indicated by the arrow, so that the engagement surface 78 of the projection 76 overlies the end of the substrate 14, as best shown in FIG. 15. In this position, the post projection 76 is in interfering relation with upper wall 62 of the enlarged region 60 of the cavity 54, so that pressure is thereby applied to the substrate 14 in order to deformably compress the pair of contact elements 30, as shown in FIG. 15, and insure good electrical connections.

Accordingly, there has been disclosed an improved rotary board retainer system for a connector assembly utilizing an intermediate board with active electrical components. While an illustrative embodiment of the present invention has been disclosed herein, it is understood that various modifications and adaptations to the disclosed embodiment will be apparent to those of ordinary skill in the art and it is intended that this invention only be limited by the scope of the appended claims.

I claim:

1. In a connector assembly which electrically interconnects a first plurality of conductors on a first surface of a dielectric substrate (14) with respective ones of a second plurality of conductors on a surface of a dielectric housing (48) and which includes at least one resilient contact element (30) including an elongated cylindrical elastomeric body member and a flexible film wrapped around said body member, said film having a third plurality of parallel straight line conductors on the surface of said film facing away said body member so that said third plurality of conductors extends around said body member, there being at least as many of said third plurality of conductors as there are of each of said first and second pluralities of conductors, and said dielectric housing having elongated open channels (24) on its surface associated with said at least one contact element and supporting a respective said contact element therein, said second plurality of conductors on said housing surface extending to end portions within said channel;

an arrangement for securing said substrate to said housing, comprising:

substrate receiving means (50) secured to said housing for receiving one end of said substrate, said receiving means being arranged to allow pivoting movement of said substrate about an axis substantially parallel to the direction of elongation of said open channel; and at lease one retaining means (68) mounted to said housing on a side of said channel away from said receiving means for holding the opposed end of said substrate, the housing having a cavity (54) associated with each said retaining means, each said cavity being open to said housing surface on the side of said channel away from said receiving means, each retaining means including a post portion (70) extending into said cavity so as to allow rotation each said retaining means between first and second positions about an axis substantially orthogonal to the direction of elongation of said channel, each said retaining means further including a head portion (72) secured to said post portion and rotatable with said post portion to allow said substrate to be received into said receiving means and pivoted past said head portion, said head portion being thereafter rotatable with said post portion so as to overlie the opposed end of said substrate;

said receiving means and said retaining means being so configured that when said substrate is received by said receiving means and thereafter held by said retaining means, each said contact element is deformably compressed by said substrate within said channels.

2. The arrangement according to claim 1 wherein said substrate receiving means includes a boss (50) having an elongated slot (52) open toward said channel, said slot being sized so that said one end of said substrate is receivable therein with sufficient clearance to allow said pivoting movement of said substrate.

3. The arrangement according to claim 1 wherein each said retaining means post portion (70) is generally cylindrical with a radially extending projection (74) remote from said head portion and said cavity (54) is generally keyhole-shaped as viewed at said housing surface (56) so as to accept said post portion therein with a predetermined angular orientation, said cavity having an enlarged region (60) remote from said housing surface, said enlarged region allowing rotation of said post portion from said predetermined angular orientation after said post portion is inserted to a predetermined depth in said cavity, said enlarged region having an upper wall (62) which interferes with said projection to prevent removal of said retaining means from said cavity unless said post portion is in said predetermined angular orientation.

4. The arrangement according to claim 3 wherein said enlarged region (60) of each said cavity (50) is formed with a pair of angularly displaced generally vertical walls (64, 66) which interfere with said post portion projection (74) so as to limit the rotation of said post portion (70).

5. The arrangement according to claim 4 wherein said pair of angularly displaced walls (64, 66) limit the rotation of said post portion (70) to approximately ninety degrees.

6. The arrangement according to claim 1 wherein said retaining means head portion (72) includes a radially extending projection (76), said projection having an engagement surface (78) which faces said retaining means post portion (70) and which is shaped and angled to conform with a second, opposed, surface of said substrate (14) so as to secure said substrate to said housing (48) while deformably compressing said contact element (30), said head portion projection subtending a limited angular range about said axis so that said retaining means is selectively rotatable to move said head portion projection out of the pivot path of said substrate to allow installation and removal of said substrate and thereafter move said head portion projection into overlying engagement with said substrate second surface.

7. The arrangement according to claim 6 wherein said engagement surface (78) is planar and is inclined at an angle extending away from said post portion (70) in both the radial and longitudinal directions.

8. The arrangement according to claim 6 wherein said retaining means head portion (72) further includes handle means (80) for effecting user rotative manipulation of said retaining means (68).

9. The arrangement according to claim 6 wherein each said retaining means post portion (70) is generally cylindrical with a radially extending projection (74) remote from said head portion and each said cavity (54) is generally keyhole-shaped as viewed at said housing surface (56) so as to accept said post portion therein with a predetermined angular orientation, each said cavity having an enlarged region (60) remote from said housing surface, said enlarged region allowing rotation of said post portion from said predetermined angular orientation after said post portion is inserted to a predetermined depth in a respective said cavity, said enlarged region having an upper wall (62) which interferes with said projection to prevent removal of said retaining means from said cavity unless said post portion is in said predetermined angular orientation, said enlarged region of said cavity is formed with a pair of angularly displaced generally vertical walls (64, 66) which interfere with said post portion projection (74) so as to limit the rotation of said post portion to approximately ninety degrees, said predetermined angular orientation of said post portion corresponding to a position of said head portion projection (76) which is out of the pivot path of said substrate (14), each said at least one retaining means (68) being rotatable approximately ninety degrees so that said engagement surface (78) overlies said substrate (14) and said post portion projection (74) is angularly disposed to prevent removal of said retaining means (68) from said cavity (54).

* * * * *

UNITED STATES PATENT AND TRADEMARK OFFICE

CERTIFICATE OF CORRECTION

PATENT NO. : 5,362,247

DATED : November 8, 1994

INVENTOR(S) : Charles J. Rodriguez

It is certified that error appears in the above-identified patent and that said Letters Patent is hereby corrected as shown below:

In claim 1, column 6, line 18, --of-- should be inserted between "rotation" and "each".

Signed and Sealed this

Seventeenth Day of January, 1995

*Attest:*

*Attesting Officer*

BRUCE LEHMAN

*Commissioner of Patents and Trademarks*